US010329940B2

(12) United States Patent
Ballard, Jr. et al.

(10) Patent No.: US 10,329,940 B2
(45) Date of Patent: Jun. 25, 2019

(54) METHOD AND SYSTEM FOR PASSIVE CLEARANCE CONTROL IN A GAS TURBINE ENGINE

(71) Applicant: General Electric Company, Schenectady, NY (US)

(72) Inventors: Henry G. Ballard, Jr., Easley, SC (US); Douglas Frank Beadie, Greenville, SC (US); John David Memmer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 955 days.

(21) Appl. No.: 14/046,072

(22) Filed: Oct. 4, 2013

(65) Prior Publication Data

US 2015/0098791 A1 Apr. 9, 2015

(51) Int. Cl.
*F01D 11/18* (2006.01)
*F01D 11/24* (2006.01)

(52) U.S. Cl.
CPC ..... *F01D 11/24* (2013.01); *F01D 11/18* (2013.01)

(58) Field of Classification Search
CPC ..... F01D 11/08; F01D 11/005; F05B 2240/11
USPC ..... 415/173.1
See application file for complete search history.

(56) References Cited

U.S. PATENT DOCUMENTS

| | | | | |
|---|---|---|---|---|
| 4,199,300 | A | 4/1980 | Tubbs | |
| 4,419,044 | A | 12/1983 | Barry et al. | |
| 5,005,352 | A | 4/1991 | Schwarz et al. | |
| 5,178,514 | A | 1/1993 | Damiral | |
| 5,192,186 | A | 3/1993 | Sadler | |
| 5,267,831 | A * | 12/1993 | Damiral | F01D 11/18 415/114 |
| 6,089,012 | A | 7/2000 | Sugishita et al. | |
| 6,272,422 | B2 | 8/2001 | Khalid et al. | |
| 6,968,696 | B2 | 11/2005 | Little | |
| 7,246,993 | B2 * | 7/2007 | Bolms | F01D 25/12 415/116 |
| 8,011,883 | B2 | 9/2011 | Schwarz et al. | |
| 8,157,512 | B2 | 4/2012 | Zhang et al. | |
| 2010/0247298 | A1 * | 9/2010 | Nakamura | F01D 11/18 415/173.1 |

* cited by examiner

*Primary Examiner* — Justin D Seabe
*Assistant Examiner* — Jason Mikus
(74) *Attorney, Agent, or Firm* — Nixon & Vanderhye P.C.

(57) ABSTRACT

A method to design a turbine including: estimating rates of thermal radial expansion for each of a stator and a rotor corresponding to a period of operation of the turbine; estimating a clearance between the rotor and the stator based on the rates of thermal radial expansion, and determining a mass or surface area of the stator or rotor based on the clearance.

19 Claims, 5 Drawing Sheets

METHOD AND SYSTEM FOR PASSIVE CLEARANCE CONTROL IN A GAS TURBINE ENGINE

BACKGROUND OF THE INVENTION

The present invention relates to clearance control in a turbine, such as a gas turbine.

Clearance in a turbine typically refers to the between the rotor of the turbine and the stator that surrounds the rotor. In a gas turbine, the rotor is typically an axial turbine having rows of buckets each mounted on a turbine wheel. The stator in a gas turbine is a casing that includes an inner annular shell supporting annular shrouds that surround the rows of buckets and rows nozzles between the bucket rows. Clearance is between the tips of the rotating buckets and annular shrouds.

Clearance is needed to allow the buckets to rotate without rubbing against the shrouds. If the clearance is too great, combustion gases leak over the tips of the buckets and do not drive the rotation of the turbine. If the clearance is too small, the tips of the buckets rub against the shroud and may cause vibration that damages the turbine.

Clearance is needed whenever the turbine buckets rotate, including while the turbine heats up during startup, while the gas turbine is hot during full speed, full load (FSFL) operation, and as the turbine cools as it shuts down. The turbine is typically formed of metal components having various heat expansion rates. In particular, the turbine wheels, buckets on the wheels and annular shells around the buckets expand and contract at different rates as the turbine heats up and cools down. Due to different rates of thermal expansion, clearance could increase or shrink as the gas turbine heats and cools.

Control systems and techniques are conventionally used on gas turbines to ensure that clearance never becomes too small during all stages of operation and does not become too large during extended periods of operation, especially at FSFL. Conventional clearance control systems and techniques may include cooling systems mounted on external skids adjacent the gas turbine, complex sensing and actuation systems for the cooling system, flow rerouting of compressed air form the compressor, and other assemblies. Conventional clearance control systems and techniques tend to be active in that they adjust the amount of a cooling fluid flowing through the shell or buckets.

Some conventional clearance systems are actuated in response to a certain operating conditions, such as at pinch points which occur when clearance is the smallest. For example, additional heating of the casing shell may be used to increase the clearance at a pinch point. Despite these conventional systems, there remains a long felt need for a clearance control system and scheme that is robust and economical.

SUMMARY OF INVENTION

An approach to clearance control for a turbine has been conceived in which the components of the turbine are designed to thermally expand and contract during operation such that sufficient clearance is maintained throughout all stages of operation. As part of the design of the turbine, the thermal expansion and contraction of the turbine components are predicted for all operating conditions. Knowing the thermal expansion and contraction of the turbine components, the clearance is predicted for each the operational phases of the gas turbine. If the predicted clearance is insufficient, adjustments are made to the design of components of the turbine, such increasing or decreasing the mass of the stator, and increasing or restricting cooling passages in the stator. After the adjustments, the clearance is again predicted to confirm that the clearance is adequate overall operating conditions. The cycle of designing the turbine to achieve a desired clearance and predicting the clearance of the current turbine design can be repeated until the clearance is acceptable at all operating conditions.

The clearance control system may be passive. The clearance control system relies on the thermal expansion of the components of the turbine. The clearance control system may be embodied without valves, actuators or other control devices for regulating the flow of cooling or heating fluid through the turbine shell.

A method has been conceived to design a turbine including: estimating rates of thermal radial expansion for each of a stator and a rotor corresponding to a period of operation of the turbine; estimating a clearance between the rotor and the stator based on the rates of thermal radial expansion, and determining a mass or surface area of the stator or rotor based on the clearance. The estimation of the clearance may include determining closure of the clearance during the period and identifying a peak value of the closure and the determination of the mass or the surface area reduces the peak.

The stator may include an inner annular shell housing the rotor, and the rotor may include a turbine wheel on which is mounted an annular row of buckets, and the estimation of the clearance may include determining a difference between a thermal radial expansion of the inner annular shell and a sum of the thermal radial expansion of the wheel and the buckets. The determination of the mass or the surface area may include determining a volume or internal surface area of a cooling passage in the inner annular shell.

The method may include estimating a peak in the clearance and reducing the peak by the determination of the internal volume or the internal surface area, the portion of the operation is a startup stage.

A method has been conceived to design an inner annular shell which houses a rotating axial turbine comprising: estimating rates of thermal radial expansion for each of the inner annular shell and the axial turbine which includes a turbine wheel and a row of buckets mounted to the wheel; estimating a clearance between tips of the buckets and an interior surface attached to the inner annular shell aligned with the tips, wherein the clearance is estimated based on the rates of thermal radial expansion, and determining a mass or internal surface area of the inner annular shell based on the clearance. The interior surface may be a surface of a shroud.

The estimation of the clearance may include determining closure of the clearance during a period of operation of the turbine and identifying a peak value of the closure, and the determination of the mass or the surface area reduces the peak. The estimation of the clearance may include determining a difference between a thermal radial expansion of the inner annular shell and a sum of the thermal radial expansion of the turbine wheel and the buckets. The determination of the mass or the internal surface area may include determining a volume or internal surface area of a cooling passage in the inner annular shell. A peak in the clearance may be reduced by the determination of the internal volume or the internal surface area.

A method has been conceived for clearance control in a gas turbine including an inner annular shell housing a turbine wheel supporting a row of turbine buckets, the method comprising: during a startup stage of the gas turbine, thermally expanding in the inner annular shell at a rate faster than thermally expanding the turbine wheel and the row of turbine buckets; directing compressed gas through an interior passage of the inner annular shell during the startup operation, and controlling a clearance between tips of the turbine buckets and an inner surface of the inner annular shell or connected to the inner annular shell, wherein the control of the clearance is achieved based on a surface area or volume of the interior passage sized to cause the inner annular shell to achieve the faster thermal expansion.

A clearance control system has been conceived for a turbine comprising: a stator; a rotor housed within the stator; a clearance between the stator and the rotor, and a cooling fluid passage internal to the stator having an internal surface area or an internal volume sized to cause the stator to expand radially at a faster rate than the radial expansion of the rotor during a startup stage of the turbine. The stator may include an inner annular shell and the rotor includes a turbine wheel and buckets mounted to the wheel. The fluid passage may include an inlet proximate to an outer surface of the stator and an outlet proximate to an inner surface of the stator.

DETAILED DESCRIPTION OF THE INVENTION

Figure 1:
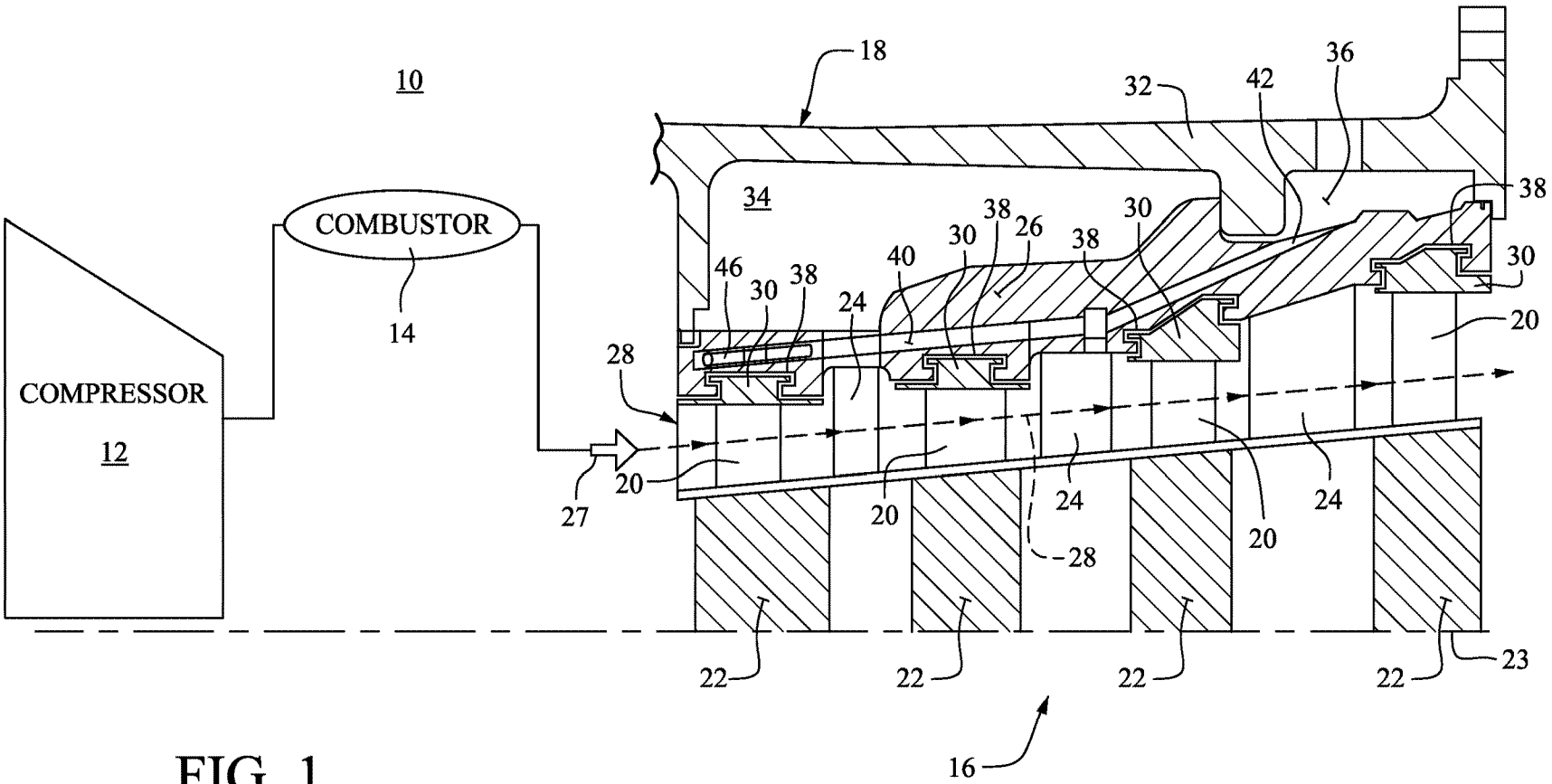
FIG. 1 is a schematic diagram of a gas turbine showing a cut-away view of the turbine and turbine shell.

FIG. 1 shows a gas turbine 10 having a compressor 12, combustor 14 and turbine 16. Gas turbines generate power by compressing air, mixing the compressed air with fuel, combusting the mixture and driving a turbine with combustion gases. The turbine includes an annular casing 18 that houses rows of turbine buckets 20 that rotate about a shaft 23. The buckets in each row are mounted on a turbine wheel 22. Between the rows of buckets are rows of nozzles 24 (guide vanes).

Hot combustion gases 27 flow in an annular passage 28 through the rows of buckets 20 and nozzles 24. The turbine casing 18 forms the outer surface of the hot gas passage 28. The inner wall of the passage is near the outer rims of the wheels 22.

The turbine casing 18 includes an outer annular shell 32 that houses and supports an inner annular shell 26. The inner annular shell surrounds the rows of buckets. The nozzles 24 are mounted to the inner annular shell 26.

Annular rows of shrouds 30 are mounted to the inner turbine shell 26 and aligned with the tips of the buckets. The gap between the shrouds 30 and the tips of the buckets 20 is referred to as the "clearance" or "clearance gap" of the gas turbine.

A small clearance ensures that minimal amounts of hot combustion gases leak over the tips of the buckets. If the clearance becomes too small, the tips of the bucket scrape against the shrouds which causes wear to the buckets and shrouds, and can create vibrations in the turbine. Wear is generally not desired as it increases the clearance gap and can lead to damage to the buckets and shrouds. Vibrations are generally not desired because they can damage the turbine.

Annular plenums 34, 36 are formed between the outer and inner annular shells 32, 26 of the turbine casing 18. These plenums 34, 36 distribute compressed air to cooling passages in the inner annular shell 26. The compressed air is extracted from one or more stages of the compressor 12. The plenum 34 around the earlier stage buckets receive air compressed to a higher degree and from a later stage of the compressor than the plenum 36 surrounding the later stage turbine. The arrangement and number of plenums in the turbine shell 18 and the selection of compressor stages to be coupled to each of the plenum is a matter of design choice.

Figure 2:
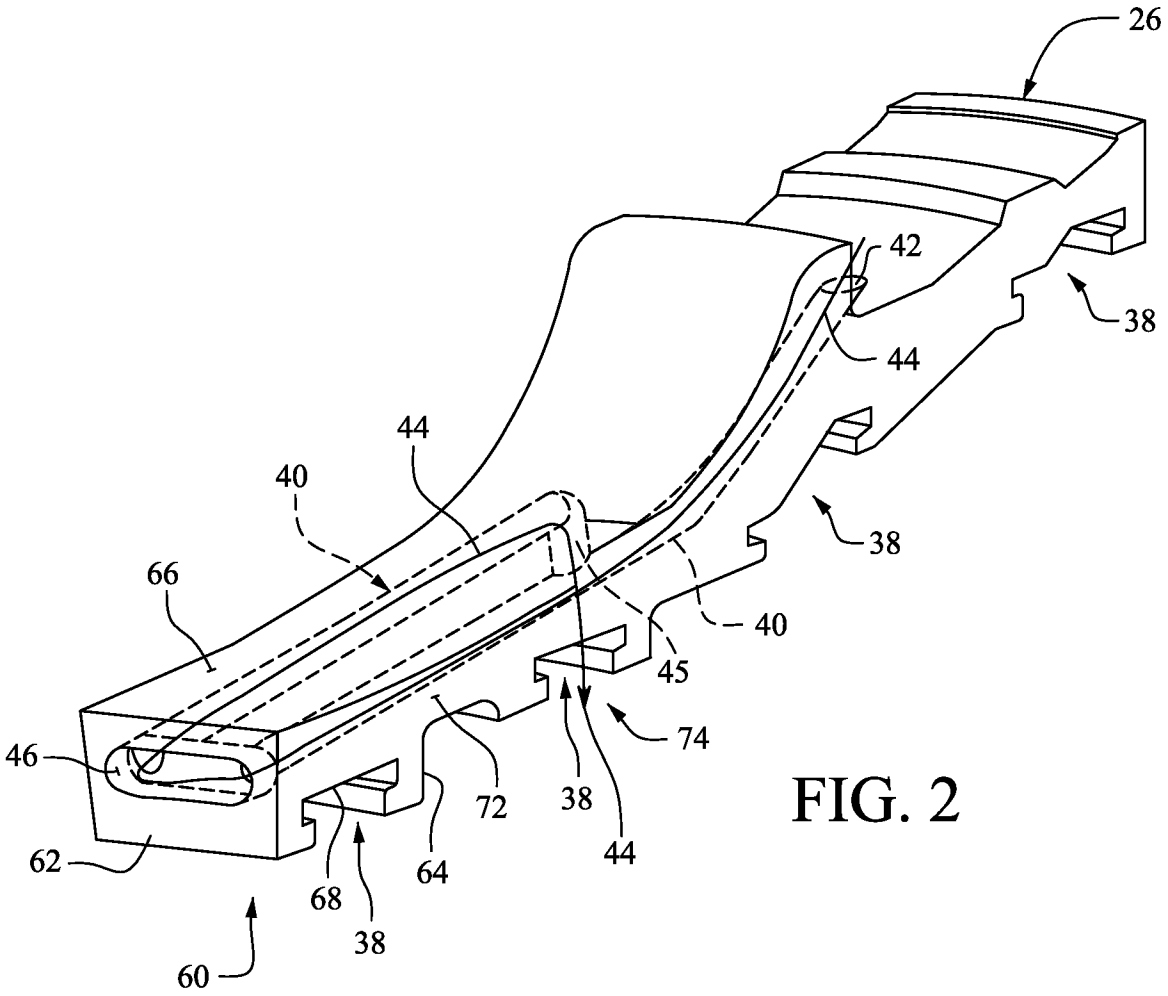
FIG. 2 is a cut-away view of a portion of an inner annular shell of the gas turbine shown in FIG. 1.

FIG. 2 is a perspective view of a section of the annular inner annular shell 26. The inner annular shell is typically formed of a metal material. The outer surface of the shell has annular ledges and ribs that engage the outer annular shell 32. The outer surface of the inner annular shell forms a wall of the plenums 34, 36 (FIG. 1) for the compressed air. The inside surface of the inner annular shell includes rows of slots 38 to receive hooks of the shrouds 30.

Internal cooling passages 40 (see dotted lines) are arranged within the inner turbine shell. Compressed air from one of the annular plenums 34, 36, enters an inlet 42 to the cooling passages 40. Air flows through the passages (see serpentine arrow 44) and exits 45 into a slot 38. The cooling passages 40 may be arranged to extend longitudinally along the rotational axis of the gas turbine. The cooling passages may follow a serpentine, e.g., switch-back, course by reversing direction at a cross-over pocket chamber 46 near an axial end of the inner annular shell. Several cooling passages 40 may be arranged symmetrically around the circumference of the turbine shell. The cross-over pocket chamber may be sealed by a plate 47 (FIG. 4) on the forward face 62 of the inner annular shell. The arrangement of the cooling passages in the shell is a matter of design choice and within the skill of an engineer experienced in design turbine shells.

The cooling passages 40 allow compressed air from the plenums 34, 46 to pass through the inner turbine shell 26 and vent into the hot combustion gas path. Heat transfer occurs between the inner turbine shell 26 and the compressed air as the air flows through the cooling passages 40. The compressed air cools the inner turbine shell if the shell is at a higher temperature than the compressed air. While hot combustion gas flows through the turbine the inner turbine shell will normally be hotter than the compressed gases. If the compressed air is warmer than the inner turbine shell, the air will heat the shell. The compressed air may be warmer before combustion occurs in the combustor during the early steps of the startup operation of the gas turbine.

The amount of heat transfer from the cooling gas into the inner annular shell depends on the internal surface areas of cooling air passages 40 and pocket chambers 46. The amount of heat transfer affects the thermal expansion and cooling of the inner turbine shell 26. Further, the volume of the cooling passages 40 and pocket chambers 46 affects the mass of the inner annular shell. The mass of the shell affects the thermal expansion of the shell.

During the design of the gas turbine, the inner annular shell is designed to have desired thermal expansion characteristics. The desired thermal expansion characteristics may be achieved, at least in part, by designing the shape, length and cross-sectional area of the cooling passages 40 and cross-over pocket chambers 46 to provide certain levels of heat transfer at the different stages of operation of the gas turbine. The desired thermal expansion characteristics may also be achieved, at least in part, by selecting volumes of the cooling passages 40 and the cross-over pocket chambers 46 to adjust the mass of the inner annular shell.

A step towards determining a desired thermal expansion of the turbine and particularly the inner annular shell is to predict the clearance gap during the different operating stages of the gas turbine. The clearance gap can be predicted by estimating the thermal expansion and contraction of the turbine components. For example, the expansion, in a radial direction, of the turbine wheel and buckets is estimated and combined to estimate the radial displacement of the tips of the buckets due to thermal expansion and contraction. Similarly, the radial displacement due to thermal expansion for the inner annular shell can be estimated. The difference between radial displacement of the tips of the buckets and that of the inner annular shell indicates the clearance gap.

The clearance gap is estimated over all normal operational conditions of the gas turbine, including cold start, fast (warm) start, steady state (such as full speed, full load) and shutdown. The estimated thermal expansions for each of the turbine components and the estimated clearance gap may be plotted to show the clearance graphically during the operational stages of the gas turbine.

Figure 3:
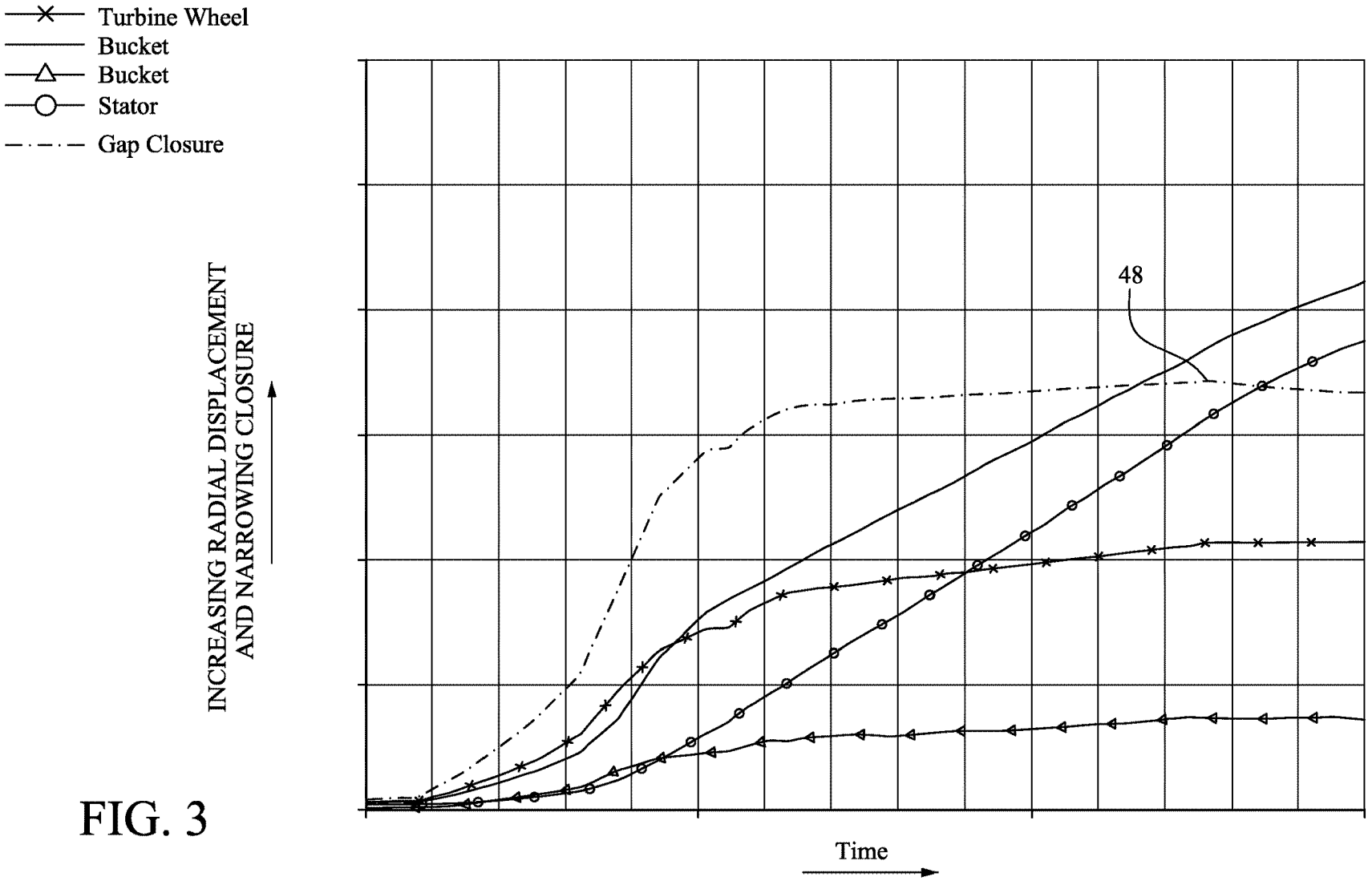
FIG. 3 is an exemplary chart showing predicted variations in the radial displacement due to thermal expansion of components of the turbine, and the closure of clearance as these components expand.

FIG. 3 is an exemplary graph showing radial displacements of turbine components during a cold start stage of a gas turbine. The graph plots time during a cold start stage versus the radial displacement of the turbine components at a particular stage of the turbine and gap closure. The estimated radial displacement is plotted of the turbine wheel (solid line), the buckets attached to the wheel (lines marked with "Δ" and "x"). The thermal displacement of the inner annular casing is represented by the line marked with "○". The clearance closure (dotted line) represents the difference of the displacement of the inner annular casing and the sum of the displacements of the turbine wheel and the buckets.

In the example shown in FIG. 3, the radial displacements for the turbine wheel (solid line) and one buckets (line marked by "x") increase more rapidly than the radial displacement (line marked by "○") of the inner annular shell (line marked with "x"). Because the displacements of the turbine wheel and bucket increases more rapidly than the inner annular shell, the clearance between the tip of the bucket and the shrouds begins to close as is indicated in the rapid increase in the clearance closure plot (dotted line). The clearance closure remains generally at a steady value as the rate increases of radial displacement of the inner annular shell.

The clearance closure plot indicates the dimension of the clearance gap during operation of the gas turbine. As the clearance closure plot increases in value the amount of the clearance gap is reduced. As is shown in FIG. 3, the increase in the clearance closure plot shows that clearance closes during startup as the rotating components (turbine wheel and buckets) of the turbine heat faster than the stationary components (inner annular shell).

The smallest clearance occurs at the peak 48 in the clearance closure plot. Abrupt and narrow peaks in the clearance closure plot indicate short periods of operation during which the clearance is the smallest. Abrupt and narrow peaks are to be reduced and minimized to avoid having to adjust the clearance to accommodate only a short period of the operation of the gas turbine.

Peaks in the clearance closure line plot may be reduced by altering the design of the turbine components. For example, increasing the surface area of the cooling passages 40 could cause more rapid heating of inner annular shell during startup. The more rapid heating may reduce a peak in the closure line plot. The closure line plot in FIG. 3 has a peak 50 than is small and not abrupt which resulted from designing the inner annular shell to heat at least as fast as the turbine wheel and buckets.

Figure 4:
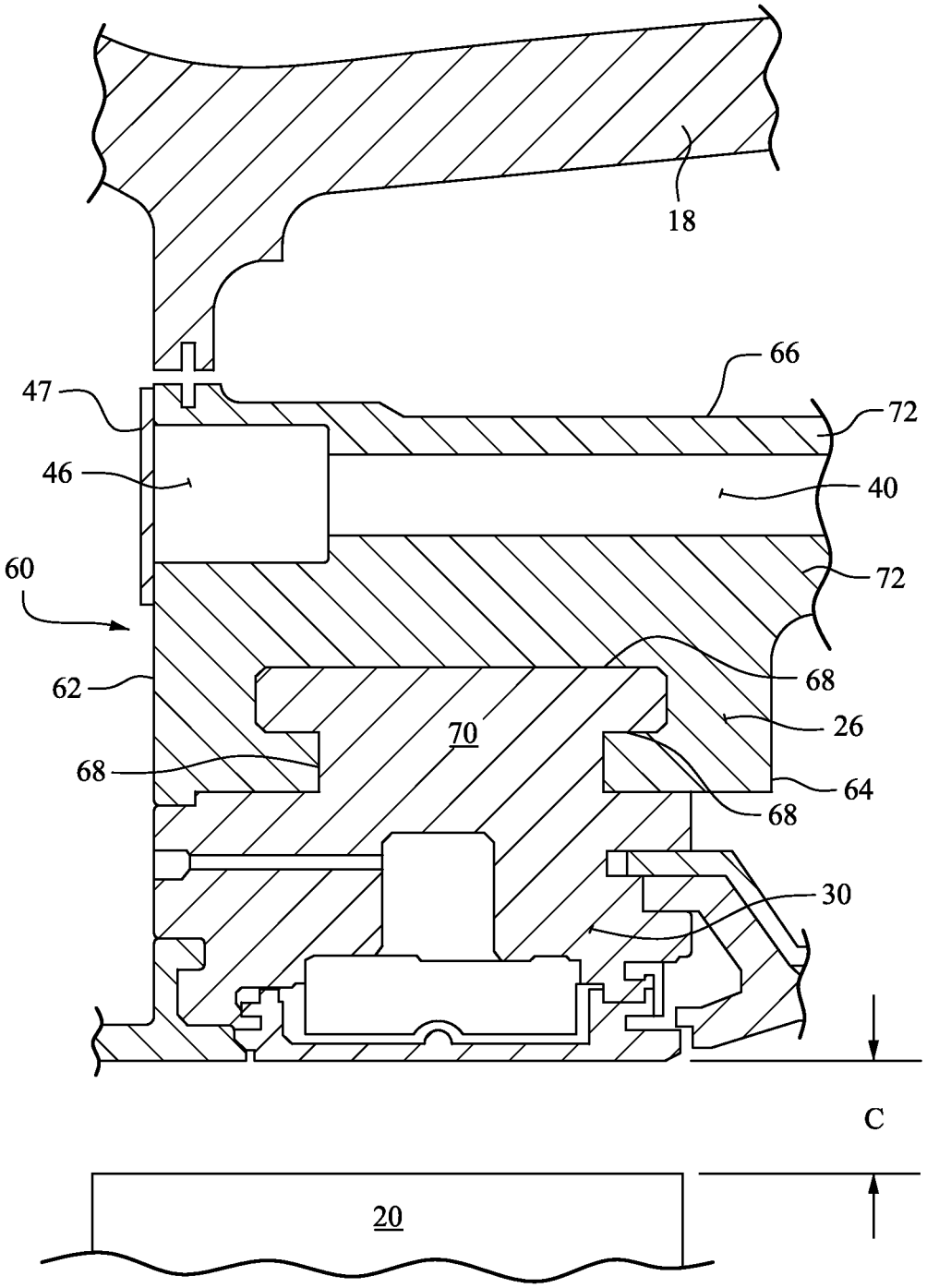
FIG. 4 is a cross-sectional view of an enlarged portion of the inner annular shell shown in FIG. 2.
Figure 5:
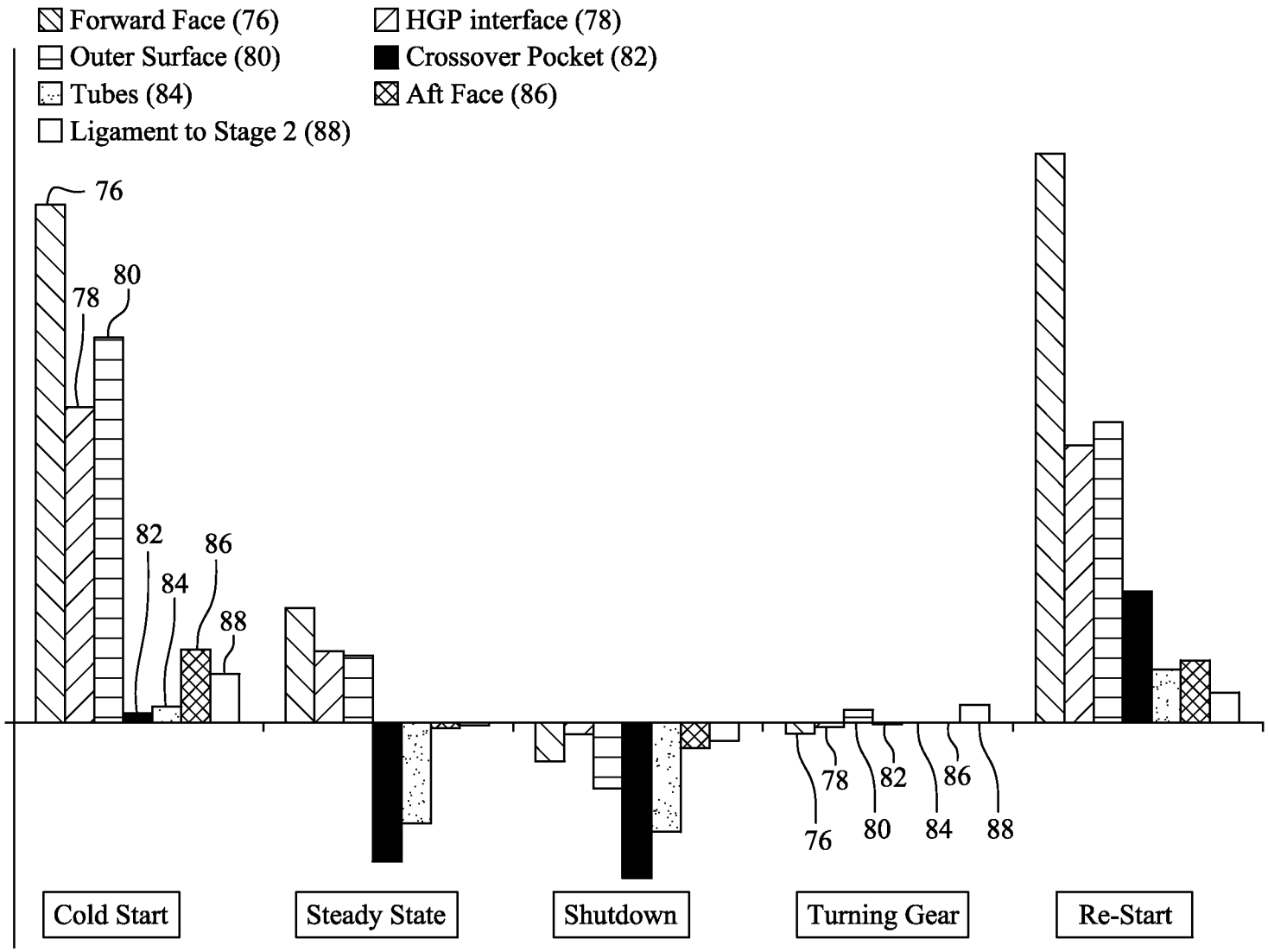
FIG. 5 is an exemplary chart showing predicted heat rates acting on the portion of the inner annular shell shown in FIG. 4.

An approach to determining the thermal expansion of the stationary components involves accounting for the heat inputs to the components of a portion 60 of the inner annular shell. This approach is illustrated in FIGS. 4 and 5. Knowing the heat transfer rates through the portion 60, the thermal expansion of the inner annular shell can be estimated.

FIG. 4 shows a cross-section of a portion 60 of the stationary components of a turbine. The portion may correspond to a stage 1 of the turbine. The portion 60 may be selected as the portion of the inner annular shell that is most prone to closing clearance gaps. The portion 60 may be used to estimate the clearance gap based on an assumption that the other portions 62 (FIG. 3) of the inner annular shell are less prone to closing clearance gaps.

The components include the inner annular shell 26 and a shroud 30. The tip of a turbine bucket 20 is shown with a small clearance gap (c) between the tip and the inner surface of the shroud. The clearance gap (c) in FIG. 4 is exaggerated for purposes of illustration. If the clearance gap (c) becomes too small, the tip of the bucket will rub against the shroud. If the gap is too large, hot combustion gases leaking through the gap will be excessive and reduce the efficiency of the turbine to convert the hot gases to work.

The thermal expansion of the stationary components, e.g., 26 and 30, may be estimated based on the heat transfer rates across the surfaces of these components. For example, heat transfer through a portion 60 of the inner annular shell proximate to a stage in the turbine may be estimated based on the heat transfer a forward face 62 and an aft face 64 of the portion 60. The portion 60 of the shell also has a radially outer surface 66 and a radially inward surface that corresponds to the slots for hooks 70 of the shroud. The radially inward surface may be treated as a hot gas passage (HGP) interface because this surface will be exposed to hot combustion gases that leak into the shroud. The portion 60 is connected by a ligament 72 to another portion 74 (FIG. 2) stage, e.g., stage 2, of the inner annular shell. While the ligament is not a surface of the portion 60, the heat transfer rate through the ligament can be estimated. The heat transfer rates through the surfaces of the cooling passages 40 and cross-over pocket chambers 46 is also considered in determining the thermal expansion of the inner annular shell.

FIG. 5 is a chart showing the heat transfer rates for each surface and ligament of the portion 60 of the inner annular surface. The heat transfer rates are shown at different stages of operation of the gas turbine.

FIG. 5 shows a graphical bar representing the heat rates 76, 78, 80, 82, 84, 86 and 88 for each stage of operation of the gas turbine. The order left-to-right of the bars (76, 78, 80, 82, 84, 86 and 88) is the same in FIG. 5 for each of the cold start, steady state, shutdown, turning gear and re-start (hot start) stages of the operation of the gas turbine.

During a cold start stage of the operation of the gas turbine, the portion 60 of the inner annular shell heats quickly because of the high rates of heat entering the shell through the forward face (rate 76), the HGP interface (rate 78) and the outer surface (rate 80). During a cold start, there is little heat transfer due to the cross-over pocket chamber (rate 82) and cooling tubes (rate 84). Also, the rates are relatively low of heat transferred to the portion 60 of the inner annular shell due to the aft face (rate 86) and through the ligament (rate 88) connection in the inner annular shell.

During the cold start stage, the inner annular shell, turbine wheel and buckets heat and expand rapidly. A person designing the turbines may prefer that the inner annular shell expand radially as fast as or faster than the turbine wheel and buckets to avoid a lack of sufficient clearance during a cold start. To increase the expansion rate of the inner annular shell, the designer may reduce the mass in the shell by, for example, increases the volume of the cooling passages 40 and the cross-over pocket chambers 46. The designer may also reduce the mass of the inner annular shell by reducing the thickness of the shell or making other adjustments to the design of the shell.

During the steady state stage, the heat rates 82, 84 for the cooling passage and cross-over pocket chamber cool the inner annular shell, while the heat rates through the forward face (rate 76), HGP interface (rate 78) and outer surface (rate 80) continue to heat the shell. A designer may want to achieve a balance between the heating rates and cooling rates of the shell during the steady state stage to minimize thermal expansion or contraction of the inner annular shell during this stage. The designer may adjust the cooling heat rates 82 and 84, for example, by changing the internal surface areas of the cooling passages 40 and the cross-over pocket chambers 46.

During the shutdown stage, the inner annular shell contracts radially inward due to the cooling heat rates. The largest cooling heat rates 82, 84 during shutdown are due to the cooling passage 40 and cross-over pocket chambers 46. The radially inward contraction of the inner annular shell during shutdown potentially could reduce the clearance if the shell contracts faster than the turbine wheel and buckets. The designer may need to consider the heat rates due to the cooling passages and cross-over pocket chambers during the shutdown stage when determining the volumes and surface areas of the cooling passages and cross-over pocket chambers. These volumes and surface areas may need to be reduced to avoid excessively fast contraction of the inner annular shell during the shutdown stage.

During the turning gear stage, there is little heat transfer through the portion 60 of the inner annular shell. Accordingly, the inner annular shell should not significantly expand or contract during the turning gear stage.

During a re-start of the gas turbine stage the portion 60 of the inner annular shell is heated due large rates of heat coming through the forward face (heat rate 76), the HGP interface (heat rate 78), and the outer surface (heat rate 80). Smaller but significant rates of heat transfer into the portion 60 come from the cross-over pocket chambers (heat rate 82), the cooling passages (heat rate 84), the aft face (heat rate 86) and the ligament (heat rate 88). The heat transfer rates during the re-start stage cause the inner annular shell to expand radially. The designer may confirm that the rate of radial thermal expansion of the inner annular shell is at least as great as the rate of radial expansion of the turbine wheel and buckets during the re-start. If a the rate of radial thermal expansion for the inner annular shell is not sufficient, the designer may reduce the mass of the shell or increase the surface areas of the cross-over pocket chambers and cooling passages.

Clearance control may be based solely on the design of the turbine. For example, the inner annular shell may be designed to thermally expand radially at least as fast as the turbine wheel and buckets during the cold start and re-start stages, and to minimize pinch points in the clearance during all operational stages.

To achieve clearance control, the designer may adjust the area of the surfaces the cooling passages and cross-over pocket chambers and change the volume of these passages and pocket chambers to adjust the mass of the inner annular shell. The surface area and volume of the cooling passages may be adjusted by changing the internal diameter of these passages. Similarly, the surface area or volume of the cross-over pocket chambers may be adjusted by changing the internal dimensions of the pocket chambers, such as the height, width or depth.

To determine whether adjustments are needed to the surface area and volume of the cooling passages and cross-over pocket chambers, the designer may consider the thermal radial displacements for the turbine wheel, buckets and inner annular shell during various operational stages, including a cold start, steady state, shutdown, turning gear and re-start stages. For each of these stages, the designer may estimate the closure of the clearance during the stage and identify a pinch point(s) where the clearance is smallest. The adjustments may be made to minimize the pinch point or the rate of change of the clearance closure near the pinch point.

In addition, the designer of a turbine may consider the rates of heating or cooling of a component of the turbine, such as an inner turbine shell. These rates may correspond to the surfaces or ligaments of a portion of the shell near a particular stage, e.g., stage one (1), of the turbine. If the combined heat rates through the surfaces or ligaments result in a thermal expansion of the shell that is not commensurate, e.g., match or slightly exceed, with the combined thermal radial expansion of the turbine wheel and buckets, the design of the inner annular shell may be changed, such as by adjusting the surface area or volume of the cooling passages and cross-over pocket chambers in the shell.

The cooling passages and cross-over pocket chambers may be designed to cause the inner annular shell to thermally expand radially faster than the turbine wheel and buckets during a cold start and a re-start operation. Similarly, the cooling passages and cross-over pocket chambers make be designed to thermally contract radially slower than the turbine wheel and buckets during a shutdown operation. Achieving these design goals should reduce the pinch points in clearance closure during operation of the gas turbine.

Clearance control in a gas turbine may be achieved by matching the thermal radial expansion and contraction of the inner annular shell with that the thermal radial expansion and contraction of the turbine wheel and buckets. The matching expansions should occur during the various operational stages of the gas turbine. The clearance control may be achieved without active devices such as cooling flow valves that adjust the flow of compressed air through passages 40 to modify the thermal expansion or contraction of the inner annular shell or with controllers to operate such valves.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method comprising estimating rates of thermal radial expansion for each of a stator and a rotor in a turbine, corresponding to a period of operation of the turbine;

estimating a clearance between the rotor and the stator based on the rates of thermal radial expansion;

calculating a volume or a surface area for at least a portion of a cooling passage in the stator or rotor based on the clearance, and forming the cooling passage in the stator or the rotor having the calculated volume or the calculated surface area for the at least a portion of the cooling passage.

2. The method of claim 1 wherein the estimation of the clearance includes determining closure of the clearance during the period and identifying a peak value of the closure and the determination of the mass or the surface area reduces the peak.

3. The method of claim 1 wherein the stator includes an inner annular shell housing the rotor and including the at least a portion of the cooling passage, and the rotor includes a turbine wheel on which is mounted an annular row of buckets, and the estimation of the clearance includes determining a difference between a thermal radial expansion of the inner annular shell and a sum of the thermal radial expansion of the wheel and the buckets.

4. The method of claim 1 wherein the at least a portion of the cooling passage includes a pocket chamber.

5. The method of claim 1 wherein the cooling passage includes a pocket chamber.

6. The method of claim 1 further comprising estimating a peak in the clearance and reducing the peak by the determination of the internal volume or the internal surface area.

7. The method of claim 1 wherein the at least a portion of the operation is a startup stage.

8. The A method related to an inner annular shell which houses a rotating axial turbine, the method comprising:

estimating rates of thermal radial expansion for each of the inner annular shell and the axial turbine which includes a turbine wheel and a row of buckets mounted to the wheel;

estimating a clearance between tips of the buckets and an interior surface attached to the inner annular shell aligned with the tips, wherein the clearance is estimated based on the rates of thermal radial expansion;

determining a surface area or volume of at least a portion of a cooling passage in the inner annular shell based on the clearance;

generating a design of the cooling passage in which the cooling passage has the determined surface area or volume; and forming the cooling passage in the inner annular shell based on the design of the cooling passage and having the determined surface area or the determined volume of the at least a portion of the cooling passage.

9. The method of claim 8 wherein the interior surface attached to the inner annular shell is a surface of a shroud.

10. The method of claim 8 wherein the estimation of the clearance includes determining closure of the clearance during a period of operation of the turbine and identifying a peak value of the closure, and the determination of the mass or the surface area reduces the peak.

11. The method of claim 8 wherein the estimation of the clearance includes determining a difference between a thermal radial expansion of the inner annular shell and a sum of the thermal radial expansion of the turbine wheel and the buckets.

12. The method of claim 8 wherein the cooling passage includes a pocket chamber and the at least a portion of the cooling passage is the pocket chamber.

13. The method of claim 8 further comprising estimating a peak in the clearance and reducing the peak by the determination of the internal volume or the internal surface area.

14. The method of claim 8 wherein the estimated ranges of thermal radial expansion correspond to a startup stage of the turbine.

15. A method for clearance control in a gas turbine including an inner annular shell housing a turbine wheel supporting a row of turbine buckets, the method comprising:

during a startup stage of the gas turbine, thermally expanding in the inner annular shell at a rate faster than thermally expanding the turbine wheel and the row of turbine buckets;

directing compressed gas through an interior passage of the inner annular shell during the startup operation, and controlling a clearance between tips of the turbine buckets and an inner surface of the inner annular shell or connected to the inner annular shell, wherein the control of the clearance is achieved, at least in part, based on a surface area and/or volume of the interior passage sized to cause the inner annular shell to achieve the faster thermal expansion, wherein the surface area or volume of the interior passage is configured to achieve the faster thermal expansion.

16. The method of claim 15 wherein the interior passage includes a cooling passage and a pocket chamber.

17. A clearance control system for a turbine comprising:

a stator;

a rotor housed within the stator;

a clearance between the stator and the rotor, and a cooling fluid passage internal to the stator having an internal surface area and/or an internal volume sized to cause the stator to expand radially at a faster rate than the radial expansion of the rotor during a startup stage of the turbine, and wherein the surface area and/or volume of the interior passage is configured to achieve the faster thermal expansion.

18. The clearance control system of claim 17 wherein the stator includes an inner annular shell and the rotor includes a turbine wheel and buckets mounted to the wheel.

19. The clearance control system of claim 17 wherein the fluid passage includes an inlet proximate to an outer surface of the stator and an outlet proximate to an inner surface of the stator.

* * * * *